US010450164B2

(12) United States Patent
Pokkinen et al.

(10) Patent No.: US 10,450,164 B2
(45) Date of Patent: Oct. 22, 2019

(54) ARRANGEMENT FOR RELEASING THE OPERATING BRAKE OF AN ELEVATOR

(71) Applicant: Kone Corporation, Helsinki (FI)

(72) Inventors: Olli Pokkinen, Helsinki (FI); Teppo Vuorio, Helsinki (FI); Arto Nakari, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 16/137,736

(22) Filed: Sep. 21, 2018

(65) Prior Publication Data

US 2019/0023531 A1 Jan. 24, 2019

Related U.S. Application Data

(63) Continuation of application No. PCT/EP2017/059522, filed on Apr. 21, 2017.

(30) Foreign Application Priority Data

May 11, 2016 (EP) ..... 16169166

(51) Int. Cl.
*B66B 5/02* (2006.01)
*B66B 5/00* (2006.01)
(Continued)

(52) U.S. Cl.
CPC ..... *B66B 5/027* (2013.01); *B66B 5/0031* (2013.01); *B66B 5/06* (2013.01); *B66B 5/044* (2013.01)

(58) Field of Classification Search
CPC ..... B66B 5/027; B66B 5/0031
See application file for complete search history.

(56) References Cited

U.S. PATENT DOCUMENTS 2,941,625 A * 6/1960 De Andrade Souza ..... B66B 5/027 187/306
5,971,109 A * 10/1999 Aulanko ..... B66B 5/027 187/263

(Continued)

FOREIGN PATENT DOCUMENTS

EP 1151953 A1 11/2001
EP 1165424 A1 1/2002

OTHER PUBLICATIONS

International Search Report PCT/ISA/210 for International Application No. PCT/EP2017/059522 dated Jun. 27, 2017.

(Continued)

*Primary Examiner* — Minh Truong
(74) *Attorney, Agent, or Firm* — Harness, Dickey & Pierce, P.L.C.

(57) ABSTRACT

The invention relates to an arrangement for releasing the operating brake of an elevator in an emergency situation and for driving an elevator car of the elevator to a floor level, comprising at least one electric operating brake of the elevator as well as a brake release lever, which brake release lever is connected with the brake via a mechanical transmission means, which arrangement further comprises an overspeed governor connected with a gripping device of the elevator car. According to the invention in between the brake release lever and the brake a coupling device is arranged, which coupling device is controlled by the overspeed governor. Via this means the car velocity is controlled also during release of trapped passengers.

12 Claims, 2 Drawing Sheets

Fig. 2

Figure 1:
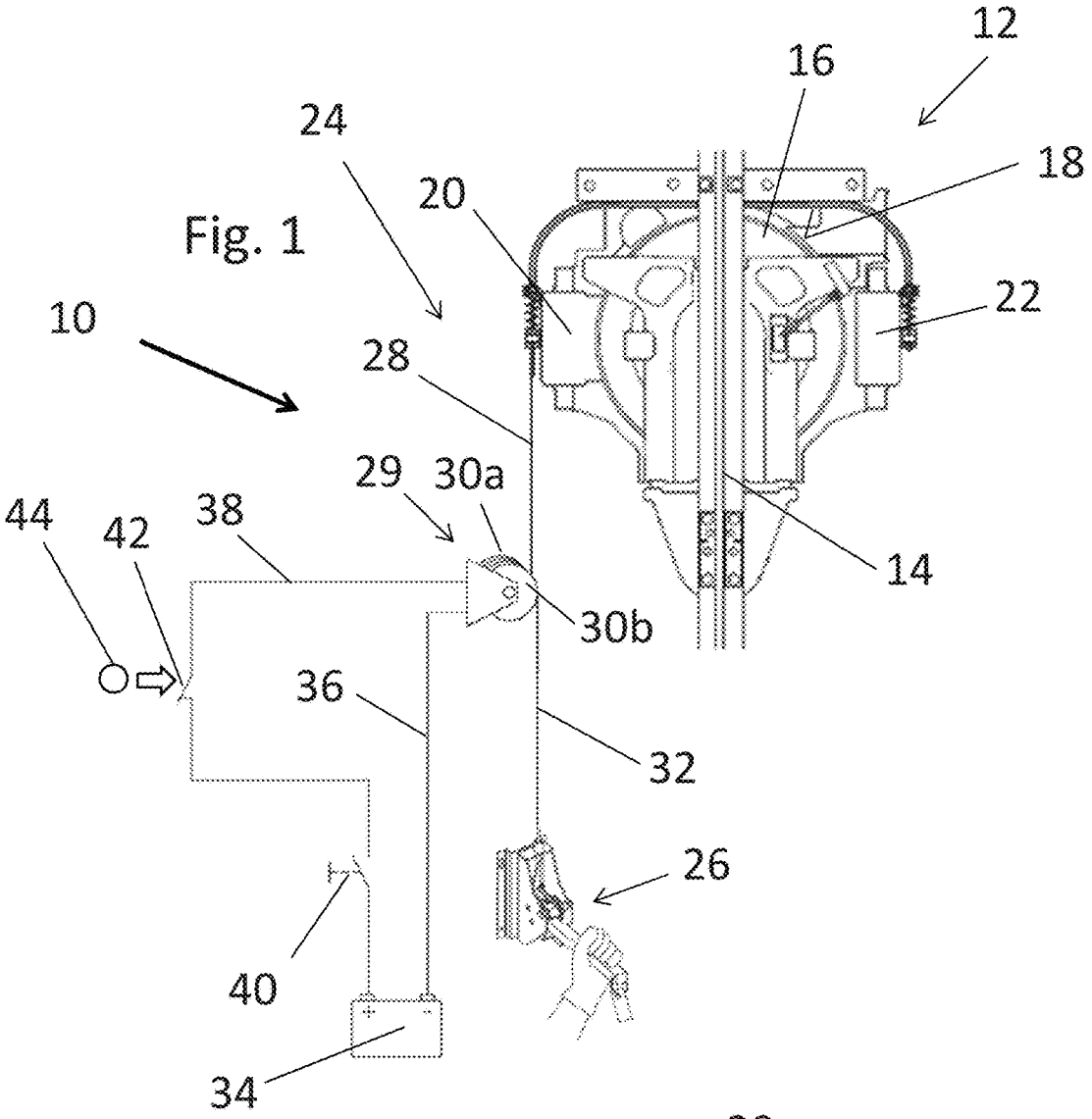

(51) Int. Cl.
*B66B 5/06* (2006.01)
*B66B 5/04* (2006.01)

(56) References Cited

U.S. PATENT DOCUMENTS

| | | | | |
|---|---|---|---|---|
| 6,196,355 | B1 * | 3/2001 | Fargo | B66B 3/00 187/287 |
| 6,405,834 | B1 * | 6/2002 | Chida | B66B 1/46 187/263 |
| 6,817,453 | B2 * | 11/2004 | Koeppe, Jr. | B66B 5/027 188/156 |
| 7,434,664 | B2 * | 10/2008 | Helstrom | B66B 1/32 187/306 |
| 7,690,483 | B2 * | 4/2010 | Tegtmeier | B66B 5/027 187/290 |
| 8,413,765 | B2 * | 4/2013 | Stratmann | B66B 5/0031 187/247 |
| 2012/0080273 | A1 | 4/2012 | Herkel et al. | |

OTHER PUBLICATIONS

Written Opinion of the International Searching Authority PCT/ISA/237 for International Application No. PCT/EP2017/059522 dated Jun. 27, 2017.

Extended European Search Report for European Patent Application No. 16169166.2 dated Oct. 31, 2016.

* cited by examiner

ARRANGEMENT FOR RELEASING THE OPERATING BRAKE OF AN ELEVATOR

This application is a continuation of PCT International Application No. PCT/EP2017/059522 which has an International filing date of Apr. 21 2017, and which claims priority to European patent application number 16169166.2 filed May 11, 2016, the entire contents of both of which are incorporated herein by reference.

The present invention relates to an arrangement for releasing the operating brake of an elevator in an emergency situation and for driving an elevator car of the elevator to a floor level. The arrangement comprises at least one electric operating brake of the elevator as well as a brake release lever. The operating brake of the elevator is usually an electric brake which is activated upon loss of electric energy supply whereby a brake shoe of the operating brake is configured to brake the rotor or the traction sheave of a drive machine of the elevator upon the force of a spring means. This operating brake comprises an electromagnet which keeps the brake shoe open when energized. The arrangement of the present invention further comprises an overspeed governor which is usually built by two pulleys located in the top and bottom of the elevator shaft which are connected by an endless rope which is at one point connected to the elevator car. With at least one of the pulleys, an arrangement is located which is activated when the car velocity exceeds a predetermined limit value. In this case, the overspeed governor actuates a gripping device of the elevator car which grips the guide rails of the elevator and therefore stops the elevator car in a secure manner, even if the elevator ropes are cut.

For manually releasing trapped passengers which are stuck in the elevator car for example in case of a power failure, usually a brake release lever is provided in a machine room or in control cabinet located at a floor of the elevator in a sidewall of the elevator shaft so that with the actuation the brake release lever the operating brake which stops the elevator car from moving is released as to allow the elevator car to move to an adjacent floor to set the trapped passengers free. The brake release lever is connected with the operating brake via a mechanical transmission means which is usually a wire, Bowden cable or push rod connection which ensures that the force applied to the brake release lever is applied to the operating brake to release it.

A problem with this known arrangement is the fact that the velocity of the elevator car might become too high during the manual brake release which may lead to dangerous situations.

It is therefore object of the present invention to provide an arrangement for manually releasing the operating brake of an elevator as well as an elevator which allows a secure release of trapped passengers.

According to the inventive arrangement, between the brake release lever and the brake a coupling device is arranged, which coupling device is controlled by the overspeed governor (OSG), e.g. by a signal thereof. This coupling device is located at any point between the brake release lever and the brake, for example within the mechanical transmission means or at a point where the brake or the brake release lever is connected with the mechanical transmission means. The coupling means which is controlled by a signal of the overspeed governor has the advantage that also during manual release of the operating brakes, the velocity of the elevator car is monitored by the overspeed governor and when the velocity of the elevator car exceeds a limit value, the coupling device is actuated to disconnect the brake release lever from the brake which results in the gripping action of the brake and thus with the stopping of the elevator car. Preferably, this action of the overspeed governor is performed at a lower limit value wherein the gripping device of the elevator car is still not activated. This means that the coupling device between the brake and the brake release lever is separated before the gripping device is actuated. This ensures that due to the overspeed of the elevator car during release of trapped passengers, the gripping device is not actuated which would then require the operation of specialized service technicians to release the gripping device which is usually a wedge brake of the elevator car gripping the guide rails and which can only be set free by pulling the elevator car in the counter-direction to the direction when the gripping device was actuated.

Thus, by the inventive solution, a secure release of the passengers is possible whereby the arrangement ensures that a lower limit value of the overspeed governor is not exceeded. Further, via the invention the car velocity is controlled also during the release of trapped passengers with the brake release lever.

The invention is related to any kind of manual rescue brake release lever. The brake release lever may also be a push button or any other type of manual activation mechanism, possibly also including spring means or any type of mechanism supporting the manual brake release action of an operator. With the invention it is possible to realize ascending car overspeed protection during use of the manual brake release lever.

Compared to current solutions with a brake release lever the invention provides following advantages:

If car speed is increased over safe limit (because of insufficient dynamic braking torque, careless operation of the lever or if the cable gets stuck) the OSG sensor will trip and drop the brakes.

Compared an electric rescue brake opening device (RBO):

Brake opening force does not have to be produced by electric power. Electric power is needed only to lock the electromechanical clutch, which cause reduction in electronic system size and complexity->reduced cost and increased reliability Less batteries are needed, can be located in a maintenance access panel (MAP) to enable easy replacement.

Has limited effect on elevator electrification

Backwards compatible with elevators having a brake releasing lever

Same device could be used with every machinery

Generally the interaction between the OSG and the coupling means could be purely mechanical, which would avoid any electric components, e.g. a Bowden cable which opens a mechanical clutch in the mechanical transmission means. Anyway, preferably the coupling device is an electric coupling device, supplied by an energy supply, particularly a battery or accumulator, which ensures the function of the inventive arrangement even in case of a power failure. In one preferred embodiment of the invention, a switch is located in a supply line between the energy supply and the electric coupling device which switch is actuated by the overspeed governor. If thus the lower limit value of the overspeed governor is exceeded, the overspeed governor opens the switch which leads to a decoupling of the electric coupling device and thus to an immediate gripping action of the elevator operating brake. The opening of the switch can be induced mechanically by the OSG, which is preferable for reliable operation of the inventive arrangement.

In a preferred embodiment of this invention, a manual push button is located in the supply line between the energy supply and the electric coupling device, which push button is located in the vicinity of the brake release lever. Of course, the push button can also be replaced by another kind of electric switch which has anyway to be actuated during the release operation. Via the arrangement of the push button in the supply line between the energy supply and the electric coupling device it is ensured that the release action is always controlled by the person releasing the trapped passengers. Thus, by releasing the push button, the supply line is immediately cut and the operating brake of the operating brake grips and stops the elevator car due to the decoupling of the electric coupling device.

Preferably, the coupling device is an electric clutch. These types of electric clutches are easily to be arranged in the mechanical transmission means between the brake release lever and the operating brake. For example, the electric clutch may comprise two pulleys which are connected via the clutch and one pulley is fixed to a cable coming from the brake release lever while the other pulley is connected to a cable going to the operating brake. When the coupling device is energized, both pulleys are connected with each other. When either the switch actuated by the overspeed governor or the manual push button is released, the coupling of the two pulleys is released and the operating brake grips upon the action of the spring means of the operating brake or induced by the tension on the mechanical transmission means.

A preferred embodiment of the invention uses a toothed clutch as an electric clutch where corresponding toothed rims connected with each of the pulleys are in contact when the electric clutch is energized and which releases as soon as the clutch is de-energized, e.g. by the action of a second spring means located between the two clutch parts or induced by the tension of the mechanical transmission means on the two pulleys. Such a kind of electric clutch is very reliable which is important for safety reasons.

If the overspeed governor opens the switch and/or a manual push button in the energy supply of the electric clutch is released, the electric current fed to the toothed electric clutch will be interrupted and the operating brakes of the elevator will drop. The mechanical link between the pulleys is disconnected because preferably on the toothed parts of the clutch a separating force is exerted when torque is applied between the pulleys of the clutch. In addition or alternatively there could be a spring between the toothed parts to increase the safety level. There will be a compromise between needed force (and thus required electric power) in the clutch and reliability of the release action. In brake release device there is either a spring or a weight that will create a tension in the cable coming from lever, thus enabling resetting of the electric clutch.

In a preferred embodiment of the invention, aside of the elevator shaft a panel is located on a floor of the elevator, which panel comprises the brake release lever. This panel may for example be the control panel of the elevator. This panel may also be located in a separate machine room if present.

In this case, preferably the panel comprises a window to the elevator shaft so that the operator releasing the elevator car is able to monitor his release action visually.

In a preferred embodiment, the panel comprises an indicator showing when the elevator car approaches a floor level. This allows a manual release of the elevator car via the brake release lever without visual monitoring of the elevator car by the operator. In this case, the operator only monitors the indicators and stops the release action, when the indicator indicates that the elevator car has approached a floor level so that the trapped passengers can be released to the floor.

As it has already been mentioned above, preferably the overspeed governor is configured to actuate the coupling device at a lower velocity limit value than a higher velocity limit value configured for the actuation or triggering of the gripping device. This has the advantage that the velocity of the elevator car during the release of the trapped passengers can be controlled by the overspeed governor without activating the gripping device which is a quite complicated matter as in case of the actuation of the gripping device, usually wedge brakes secure the elevator car in a very rigid manner to the guide rails. This release cannot be performed by a regular operator, for example the janitor of a building but requires specialized service technicians of the elevator company as the elevator car has to be drawn in counter-direction of the stuck direction in which the wedging of the gripping device has taken place. This is difficult particularly in cases where the wedging direction of the gripping device is the down direction because then the elevator car has to be drawn against its own weight. If the elevator has a counterweight, the wedging direction is usually the upwards direction if the counterweight is heavier than the elevator car including passengers or the down direction if the car inclusive the trapped passengers is heavier than the counterweight.

The invention also comprises an elevator having at least one elevator car running in at least one elevator shaft, which elevator car is driven by an elevator drive machine which is braked by an operating brake of the elevator and which elevator comprises an arrangement of the above-mentioned type.

Preferably, the elevator further comprises a panel which is separated from the elevator shaft and which comprises the brake release lever. This panel may either be located aside of the elevator shaft at a floor of the elevator or of the building in which the elevator is installed or a separate machine room. Preferably, the elevator comprises a window in or in the vicinity of the panel, which window is directed to the elevator shaft and thus enables monitoring of the release action by the operator. Theoretically the panel is e.g. a maintenance access panel or control panel which could be located in a lower floor, for example in a penthouse situation although the most preferred place for the panel is the top floor, which is nearest to the hoisting machine.

In a preferred embodiment of the invention, the elevator further comprises guide rails for guiding the elevator car in the shaft, a gripping device actuated by an overspeed governor and an overspeed governor. The overspeed governor comprises usually two pulleys which are arranged in the top and bottom of the elevator shaft and an overspeed governor rope running around these pulleys. The rope is connected at one point with the elevator car so that the pulleys rotate according to the velocity of the elevator car. In connection with at least one pulley, an arrangement is located which is activated dependent on the velocity of the overspeed governor pulley. Of course the OSG could mechanically open a connection, e.g. clutch, in the transmission means between the brake release lever and the brake. Preferably, the overspeed governor further comprises a switch operated dependent on the car velocity and the switch is located in a supply line between an energy supply, for example a battery or an accumulator, and the electric coupling device, for example the electric clutch. In this case, the overspeed governor is preferably configured to activate the switch between the energy supply and the electric coupling device at a lower limit value at which the gripping device of the elevator car is still not actuated. This allows the control of the elevator speed during release of the trapped passengers without activating the gripping device.

If an electric coupling device is used preferably a battery or accumulator is used as energy supply for the electromechanical clutch will be supplied by a battery, located in MAP. Preferably, a charger is arranged to keep the battery constantly charged.

In a preferred embodiment of the inventive elevator, a manual push button is located in a supply line between the energy supply and the electric coupling device, which push button is located in the vicinity of the brake release lever. The release action is then actively monitored by the operator which has on the one hand to operate the brake release lever and on the other hand to push the push button to move the elevator car to the next floor for the release of the trapped passengers.

It is for the skilled person obvious that the above-mentioned embodiments can be combined with each other arbitrarily.

It shall further be clear for the skilled person that a single component may be provided several times. For example, the elevator may be an elevator group with several elevators in which case the inventive arrangement is provided in connection with each elevator car. In the above embodiment, the action of the overspeed governor has been described in connection with a switch located between an energy supply and an electric coupling device. This arrangement may also be replaced by a mechanical connector connecting the brake release lever with the brake.

Figure 2:
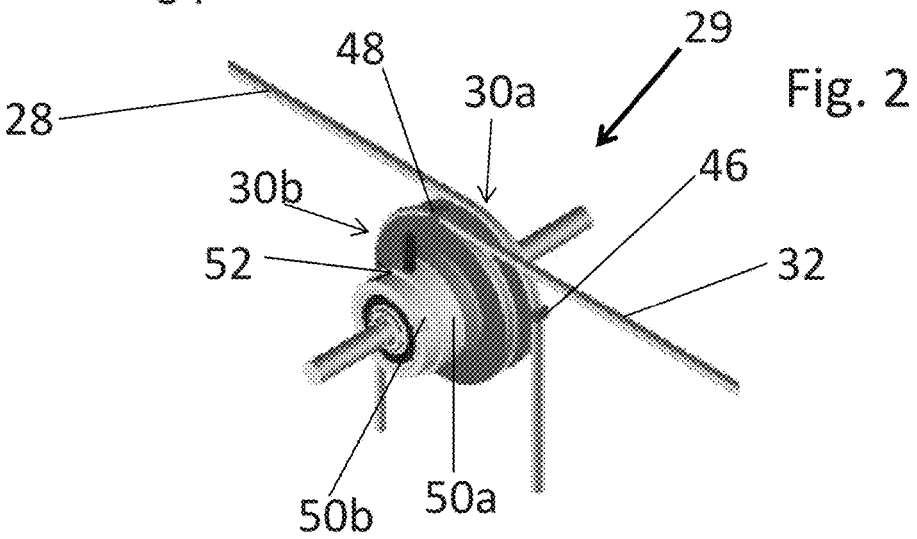
Figure 3:
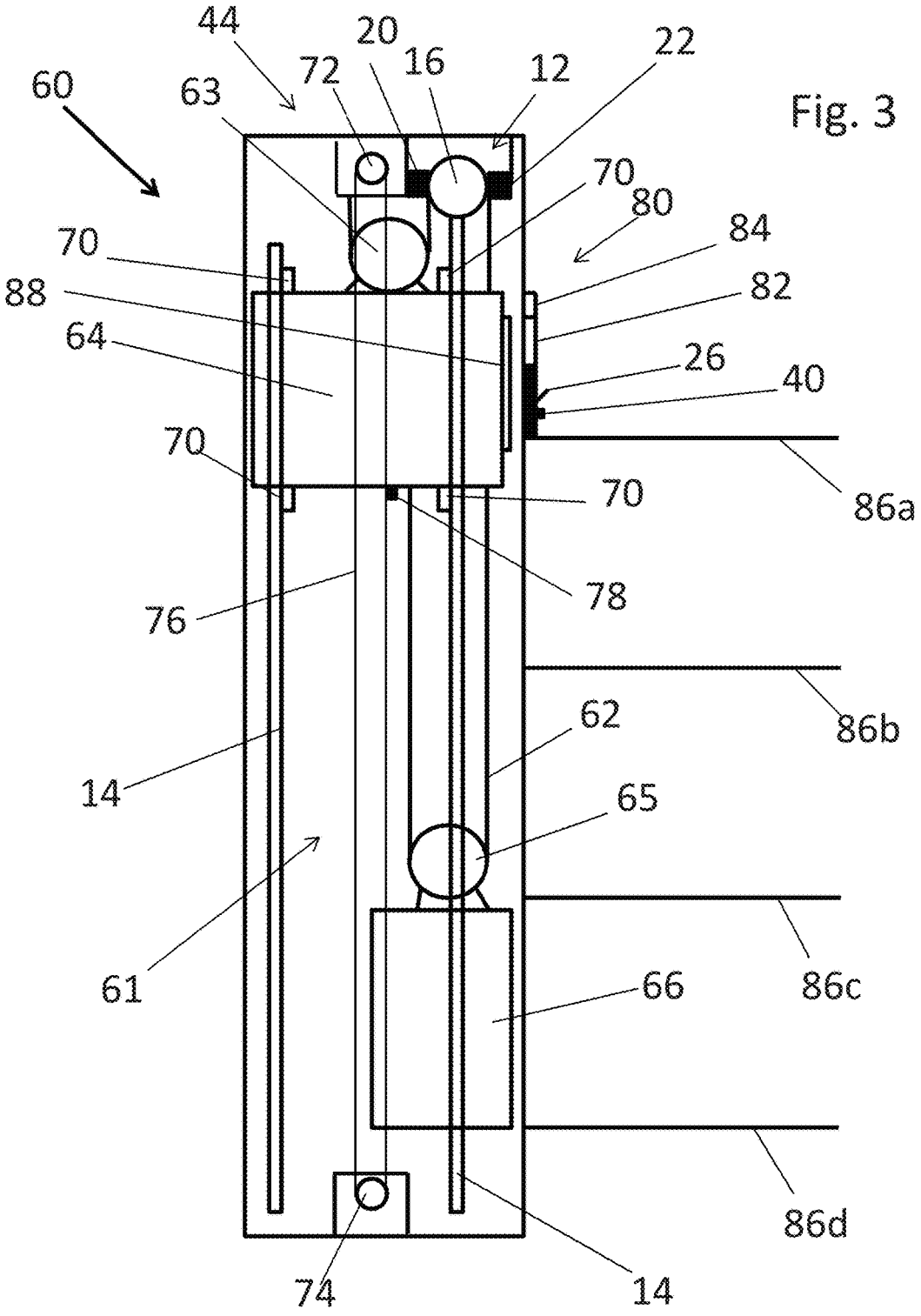

Following terms are used as synonyms: brake release lever—manual activation mechanism; overspeed governor—OSG; mechanical transmission means—Bowden cable; electric coupling means—electric clutch; drive machine—elevator drive machine;

The invention is now described by means of an example in connection with the appended drawing. In this drawing:

FIG. 1 shows a schematic diagram of the inventive arrangement with an electric clutch as an coupling device, FIG. 2 a detailed perspective view of the electric clutch of FIG. 1, FIG. 3 a schematic side view of an elevator having a panel with a brake release lever and an arrangement according to FIGS. 1 and 2.

FIG. 1 shows an inventive arrangement 10 of an elevator comprising an elevator drive machine 12 mounted on a guide rail 14 of the elevator which elevator drive machine comprises a rotor 16 (and/or traction sheave) having a rim 18 which is gripped by two operating brakes 20, 22 of the drive machine 12. Both operating brakes 20, 22 are connected via a mechanical transmission means 24, e.g. via a Bowden cable, with a manual brake release lever 26. The mechanical transmission means 24 comprises a first cable 28 going from both operating brakes 20, 22 to a first pulley 30*a* of an electric clutch 29 whereas the brake release lever 26 is connected via a second cable 32 with a second pulley 30*b* of the electric clutch 29. The electric clutch 29 is connected with a battery 34 as energy supply. The battery 34 is connected via two supply lines 36, 38 with the electric clutch 29. In one of the supply lines 38, a mechanical push button 40 is located in the vicinity of the brake release lever 26. Furthermore, in the second supply line 38, a switch 42 is located which is controlled by the overspeed governor 44. As long as the overspeed governor detects a car velocity below a lower limit value, the switch 42 is closed. If this lower limit value is exceeded by the car velocity, the switch 42 is opened. Thus, for releasing the both operating brakes 20, 22 of the drive machine 12 it is necessary that the brake release lever 26 activated, that the manual push button 40 is continuously pushed and that the OSG does not detect an overspeed situation exceeding a lower limit value below a higher limit value for the activation of the gripping device of an elevator car (See FIG. 3). In this case, the electric clutch 29 which acts as electric coupling element between the two cables 28, 32 are connected so that the actuating force from the brake release lever 26 is indeed transmitted via both cables 28, 32 to both brakes 20, 22 of the elevator drive machine. Thus, the release of trapped passengers is possible. If the operator releases the manual push button or the overspeed governor senses the exceeding of the lower limit value of the car velocity, the energy supply to the electric clutch is immediately disconnected and the both pulleys 30*a*, 30*b* are disconnected so that the mechanical connection between the cables 28 and 32 is disconnected leading in the immediate gripping of the operating brakes 20, 22 which are biased into the gripping action via internal spring means.

Of course, the switch 42 and the manual push button 40 can be located in both supply lines 36, 38 and do not need to be located in only one supply line 38. Furthermore, the manual push button 40 is optional and only serves to improve the operating security of the brake release lever. The manual push button may also be left away. The brake release lever may also be substituted by any similar mechanical releasing device.

FIG. 2 shows the electric clutch 29 of FIG. 1 in more detail. The drawing shows the connection of the first cable 28 running from the operating brakes 20, 22 to the first pulley 30*a* of the electric clutch and being fixed there with a clamp 46. The second cable 32 is running from the brake release lever 26 to the second pulley 30*b* of the electric clutch and being fixed there with a second clamp 48. Both pulleys 30*a*, 30*b* are connected with respective parts of annular clutch members 50*a*, 50*b* having an adjacent toothed rim 52 whereby the electric clutch 29 comprises an electromagnet which pulls both annular clutch members 50*a*, 50*b* together so that they are interlocked via the toothed rim 52. The electric clutch preferably comprises an internal spring means which biases the two annular clutch members 50*a*, 50*b* in opening direction, or this biasing is realized with the tension on the cables 28, 32. Thus, it requires energy to connect the both annular clutch members 50*a*, 50*b* and thus the two pulleys 30*a*, 30*b* of the electric clutch 29.

Finally, FIG. 3 shows an elevator 60 in which the arrangement 10 of FIGS. 1 and 2 is installed. The elevator comprises a drive machine 12 with a rotor 16 having a rim 18 which is gripped by two operating brakes 20, 22. The drive machine 12 is a traction sheave drive machine having a traction sheave around which a suspension rope 62 is running. One end of the suspension rope 62 is fixed at a diverting pulley 63 of an elevator car 64 whereas the other end of the suspension rope 62 is fixed to a diverting pulley 65 of a counterweight 66. The elevator car 64 runs with guide shoes along guide rails 14 whereby the guide rails for the counterweight 66 are not shown for clarity reasons. The elevator car 64 comprises a gripping device 70 which is actuated by an overspeed governor 44 having an upper rope pulley 72 and a lower rope pulley 74 in the top of the elevator shaft. Between both rope pulleys 72, 74 of the overspeed governor 44, an overspeed governor rope 76 is running which is fixed at a fixing point 78 to the elevator car 64. The overspeed governor 44 comprises a mechanism monitoring the velocity of the upper overspeed governor pulley 72, for example a mechanical rotative force monitoring device and a switch 52 which is arranged in the supply line 38 between the energy supply 34 and the electric clutch 29. The elevator further comprises a control panel 80 in which the brake release lever 26 as well as the manual push button 40 is located (if the optional push button 40 is provided). Furthermore, the panel 80 comprises preferably a window 82 allowing a view into the elevator shaft 61 as well as an indicator 84 (e.g. LED) which indicates the approach of a landing floor 86*a-d* by the elevator car 64 so that trapped passengers may exit via car doors 88 to one of these floors. The invention allows a safe release of trapped passengers without the danger of overspeed of the elevator car during the release action. The brake release lever may also be located in a machine room or in the elevator shaft.

The invention is not limited to the embodiment of the drawings but may be varied within the scope of the appended patent claims.

LIST OF REFERENCE NUMBERS

10 Brake release arrangement
12 Elevator drive machine
14 guide rail
16 rotor—traction sheave
18 rim of the rotor—traction sheave
20 first operating brake
22 second operating brake
24 mechanical transmission means
26 brake release lever
28 first cable of the mechanical transmission means (Bowden cable)
29 electric clutch—electric coupling device
30*a, b* first and second pulleys of the electric clutch
32 second cable of the mechanical transmission means
34 energy supply—battery—accumulator
36 first supply line
38 second supply line
40 manual push button switch
42 switch controlled by the overspeed governor
44 overspeed governor
46 first clamp for fixing the first cable to the first pulley of the electric clutch
48 second clamp for fixing the second cable to the second pulley of the electric clutch
50*a, b* first and second annular clutch members
52 toothed rim
60 elevator
61 elevator shaft
62 elevator rope
63 diverting pulley of the elevator car
64 elevator car
65 diverting pulley of the counterweight
66 counterweight
70 gripping device
72 upper overspeed governor pulley
74 lower overspeed governor pulley
76 overspeed governor rope
78 fixing point of car with overspeed governor rope
80 operating panel of the elevator
82 window
84 approach indicator
86*a-d* elevator floors—building floors
88 car doors

The invention claimed is:

1. An arrangement for releasing an operating brake of an elevator in an emergency situation and for driving an elevator car of the elevator to a floor level, the arrangement comprising:

at least one electric operating brake of the elevator, a brake release lever connected with the electric operating brake via a mechanical transmission device, an overspeed governor connected with a gripping device of the elevator car, an electric coupling device arranged between the brake release lever and the electric operating brake, the electric coupling device being an electric toothed clutch whose energy supply from an energy supply source is controlled by the overspeed governor, the electric toothed clutch including a first pulley and a second pulley, the first pulley being connected with a first part of the mechanical transmission device leading to the electric operating brake and the second pulley being connected with a second part of the mechanical transmission device leading to the brake release lever, and a switch located in a supply line between the energy supply source and the electric coupling device, the switch being actuated by the overspeed governor.

2. The arrangement according to claim 1 wherein the electric coupling device is arranged in the mechanical transmission device.

3. The arrangement according to claim 1, further comprising a manual push button switch located in the supply line between the energy supply source and the electric coupling device, which push button switch is located in a vicinity of the brake release lever.

4. The arrangement according to claim 1, wherein next to an elevator shaft, a panel is located on a floor of the elevator, the panel including the brake release lever.

5. The arrangement according to claim 4, wherein the panel comprises a window to the elevator shaft.

6. The arrangement according to claim 4, wherein the panel comprises an approach indicator showing when the elevator car has approached a floor level.

7. The arrangement according to claim 1, wherein the overspeed governor is configured to actuate the electric coupling device at a lower velocity limit value than a higher velocity limit value for actuation of the gripping device.

8. An elevator system comprising:

the arrangement according to claim 1;

the elevator car running in at least one elevator shaft;

an elevator drive machine configured to drive the elevator car.

9. The elevator system according to claim 8, further comprising:

an operating panel separated from the elevator shaft comprising the brake release lever.

10. The elevator system according to claim 9, further comprising:

a window in or in a vicinity of the operating panel, the window directed to the elevator shaft.

11. The elevator system according to claim 8, further comprising:

guide rails for guiding the elevator car in the elevator shaft, the gripping device actuated by the overspeed governor.

12. The elevator system according to claim 11, further comprising a manual push button switch located in the supply line between the energy supply source and the electric coupling device, which push button switch is located in a vicinity of the brake release lever.

* * * * *